US008845345B2

(12) United States Patent
Gattwinkel et al.

(10) Patent No.: US 8,845,345 B2
(45) Date of Patent: Sep. 30, 2014

(54) ELECTRICAL PLUG-IN DEVICE WITH CLOSURE DEVICE

(75) Inventors: Stefan Gattwinkel, Kirchhundem (DE); Volker Lazzaro, Kirchhundem (DE); Markus Kebben, Kirchhundem (DE)

(73) Assignee: Amad Mennekes Holding GmbH & Co. KG, Kirchhundem (DE)

( * ) Notice: Subject to any disclaimer, the term of this patent is extended or adjusted under 35 U.S.C. 154(b) by 0 days.

(21) Appl. No.: 14/005,086

(22) PCT Filed: Mar. 1, 2012

(86) PCT No.: PCT/EP2012/053558

§ 371 (c)(1), (2), (4) Date: Sep. 13, 2013

(87) PCT Pub. No.: WO2012/123265

PCT Pub. Date: Sep. 20, 2012

(65) Prior Publication Data

US 2014/0011380 A1 Jan. 9, 2014

(30) Foreign Application Priority Data

Mar. 16, 2011 (DE) ..... 10 2011 001 300

(51) Int. Cl.
*H01R 13/44* (2006.01)
*H01R 13/453* (2006.01)
*H01R 43/26* (2006.01)

(52) U.S. Cl.
CPC ..... *H01R 13/4532* (2013.01); *H01R 13/4534* (2013.01); *H01R 43/26* (2013.01)
USPC ..... 439/137

(58) Field of Classification Search
USPC ..... 439/135, 136–140, 148, 149, 157; 174/66, 67
See application file for complete search history.

(56) References Cited

U.S. PATENT DOCUMENTS

| | | | | |
|---|---|---|---|---|
| 7,273,383 | B1 * | 9/2007 | Bennett | 439/142 |
| 7,980,885 | B2 | 7/2011 | Gattwinkel et al. | |
| 8,704,092 | B2 * | 4/2014 | Zhang | 174/67 |
| 2009/0221176 | A1 | 9/2009 | Gattwinkel et al. | |

FOREIGN PATENT DOCUMENTS

| | | | |
|---|---|---|---|
| EP | 0 714 152 | A1 | 5/1996 |
| EP | 2 075 889 | A2 | 7/2009 |
| FR | 2 723 476 | A1 | 2/1996 |

OTHER PUBLICATIONS

International Search Report issued by the European Patent Office in International Application PCT/EP2012/053558.

* cited by examiner

*Primary Examiner* — Renee S Luebke
*Assistant Examiner* — Harshad Patel
(74) *Attorney, Agent, or Firm* — Henry M. Feireisen LLC

(57) ABSTRACT

A plug-in device system has a closure unit blocking access to a first plug-in device element, for example a socket. The closure unit includes a rotary bezel which is coupled via a coupling to at least one shutter such that the rotation of the bezel effects a movement of the shutter from a closed position in an open position. Preferably, a locking assembly is additionally provided, which blocks movement of the rotary bezel and/or shutter in the closed position as long as no pressure is applied to the shutter. In addition, a safety device can be provided, which prevents the shutter from opening when a direct force is applied.

25 Claims, 7 Drawing Sheets

ELECTRICAL PLUG-IN DEVICE WITH CLOSURE DEVICE

CROSS-REFERENCES TO RELATED APPLICATIONS

This application is the U.S. National Stage of International Application No. PCT/EP2012/053558, filed Mar. 1, 2012, which designated the United States and has been published as International Publication No. WO 2012/123265 A1 and which claims the priority of German Patent Application, Serial No. 10 2011 001 300.8, filed Mar. 16, 2011, pursuant to 35 U.S.C. 119(a)-(d).

BACKGROUND OF THE INVENTION

The invention relates to an electrical plug-in device system having a first and a second plug-in device element and a closure device which is arranged in front of the first plug-in device element. The invention also relates to a closure device for such a plug-in device system and a method for controlling access of a plug-in device element to another element.

Electrical plug-in connectors such as plugs or couplings for high currents according to DIN VDE 0623, EN 60309-2 ("CEE plug-in connectors") or IEC 62196 ("e-car charging connectors") typically include in a housing a contact module with electrical contacts (pins or sockets). A complementarily formed plug-in element (coupling or plug) can be inserted into the contact module from an access side to establish electrical contact to the contact elements. It is known to provide the access side of such plugs with a hinged cover to protect them against the ingress of dirt and moisture when not in use and to prevent an accidental contact with live components. Such a hinged cover has to be manually moved by the user to an open position prior to insertion of a complementary plug-in device element.

SUMMARY OF THE INVENTION

Against this background, it was an object of the present invention to provide device for a safe and robust control of authorized access to a plug-in device element, which can be realized in a confined space.

According to a first aspect of the invention, an electric plug-in device system includes the following components:

- A first plug-in device element and a compatible second plug-in device element which can be assembled with the first plug-in device element through movement in an insertion direction. Such plug-in device elements are generally known and are used to connect electrical wires to one another. The plug-in device elements are typically used as "receptacle" or "coupling", on one hand, and as a "plug", on the other hand. In the context of the present invention, these may particularly include high-current plug-in connectors or plug-in charging connectors for electric vehicles.
- A closure device disposed in front of the first plug-in device element. The words "in front" refer to the above-described insertion direction in the sense that the second plug-in device element must first pass the closure device before reaching the first plug-in device element. The closure device thus serves to control access to the first plug-in device element.

Furthermore, the plug-in device system is characterized in that the closure device contains the following components:

a) A rotatably mounted bezel with a passage opening into which the second plug-in device element can engage in a rotationally-fixed manner. The geometric shape of the "bezel" can be almost arbitrary, and must not necessarily be a closed "ring" in a strict sense. The "through-opening" of the bezel can also be designed as desired, as long as it allows a (partial) passage of the second plug-in device element. Lastly, the plug-in device element can engage with the bezel in a "rotationally-fixed manner" at any position, whereby the rotationally-fixed or twist-free connection has to be present when the second plug-in device element is in the through-opening. It is particularly preferred when the through-opening has an inside contour which corresponds at least partially to a non-circular outside contour of the second plug-in device element; in which case, the rotationally-fixed engagement is established by a form fit in the through-opening itself.

b) At least one shutter, which can be moved between a closed position, in which the first plug-in device element (viewed from the insertion direction) is at least partially covered, and an open position, in which the shutter allows access to first plug-in device element. The shutter can have any geometric shape and can be movable in any direction (displacement, pivoting and/or rotation). In a particularly preferred embodiment, the shutter may be substantially plate-shaped and can be moved in the plane of the plate, since this enables a particularly flat design. The movement of the shutter is preferably also in a plane perpendicular to the insertion direction.

c) Coupling device configured to convert a rotational movement of the rotary bezel into a movement of the shutter from the closed position into its open position.

Since the closure device is a separable element from plug-in device elements, both physically and as a sales product, the invention further relates to a separate closure device for controlling access of a second plug-in device element to a complementary first plug-in device element.

Lastly, the invention relates to a method for controlling access of a second plug-in device element to a complementary first plug-in device element, including the steps of:

At least one shutter (initial) blocks in a closed position access to the first plug-in device element.

The second plug-in device element is brought into a rotationally-fixed engagement with a rotary bezel, and then rotated, thereby carrying the rotary bezel along.

The rotation of the bezel moves the shutter into an open position, releasing access to the first plug-in device element.

The second plug-in device element is inserted into the first plug-in device element through movement along a plug-in axis. The axis may in particular be identical to the axis about which the second plug-in device element was previously rotated while carrying the rotary bezel along.

The electrical plug-in device system, the closure device and the method are based on the fact that the rotational movement of a (second) plug-in device element opens a closure device, thus providing access to a complementary (first) plug-in device element. Since this approach still requires the rotational engagement of the (second) plug-in device element with a rotary bezel, it can be designed with a high level of safety against abuse by ensuring that a rotation of the bezel can be generated only by the "correct" plug-in device element and not through misuse by a tool or by hand.

In the following, various improvements of the invention will be described, which can be realized in the plug-in device system, in the closure device, and in the method.

Preferably, several shutters are provided which commonly cover in their closed position access to the first plug-in device element. The travel of a single shutter from its closed position to its open position can thus be reduced. In a particularly preferred embodiment, two shutters are provided, which each cover in the closed position by a portion (for example, half) of the first plug-in device element, and which can preferably be moved in opposite directions. Interference or resistance forces can then substantially compensate each other with the movement in opposite directions.

The rotational movement of the rotary bezel can be converted into a movement of the shutter in various ways, which also depend on the type of movability of the shutter. Specifically, the rotary bezel may have teeth disposed on a circular arc, which engage with a rack on the shutter. In this way, the rotational movement of the rotary bezel can be converted into a linear movement of the rack—and thus also of the shutter.

According to another embodiment of the invention, the closure device includes locking means, with which the movement of the shutter and/or the rotary bezel is blocked in the closed position, wherein the blocking is released only by pressure acting on the shutter in the insertion direction. Such pressure acting in the insertion direction can be produced naturally by applying the second plug-in device element on the closure device, since the second plug-in device element for establishing the desired connection to the first plug-in device element has to be moved anyway in the insertion direction. The normal movement during insertion thus leads almost automatically to a release of the locking means. Merely rotating the bezel (without applying pressure on the shutter), as may occur in a fraudulent opening attempt, does not cause the closure device to open, because the locking means prevents any movement of the shutter and/or the rotary bezel.

The locking means can be implemented structurally in various ways. For example, the shutter may be movably supported against a restoring force in the insertion direction. A (sufficiently large) pressure on the shutter can then cause displacement of the shutter in the insertion direction, which can in turn be used to release blocking by of the locking means.

The locking means may include, in particular, projections engaging in holes. In this way, movement of the projections perpendicular to their axis can be blocked. The projections may be arranged, for example, on the rotary bezel or on the housing of the closure device, whereas the holes may be arranged on the shutter, or vice versa. A pressure on the shutter in the insertion direction must then cause the projections to exit from the holes and to move freely. This can be achieved, in particular in the aforedescribed embodiment, in that the shutter together with its holes (or projections) moves in the insertion direction, whereas the projections (or holes) remain stationary.

The aforedescribed locking means prevent the closure device from being opened by a torque on the rotary bezel alone. However, this protection could potentially be circumvented by tampering directly with the shutter, if a pressure is exerted on the shutter, which unblocks the locking means. In order to avoid such tampering, the closure device may be optionally provided with safety means that block movement of the shutter in the closed position that is produced solely by directly applying a force on the shutter.

The safety means may be provided independently of the presence of the locking means. Particularly preferred, however, the safety means are provided in addition to the locking means and are configured to be effective even when the locking means are unblocked (i.e. when pressure is applied on the shutter).

Advantageously, the safety means are further configured so as to prevent in the closed position movement of the shutter that is produced by an active rotation of the rotary bezel. In other words, the safety means suspend the generally effective movement and force coupling between cover and rotary bezel in both directions at least for the closed position, allowing the coupling at most in only one direction (in the direction from the rotary bezel to the shutter).

The suspension of the aforedescribed bi-directional coupling between the rotary bezel and the shutter in the closed position may optionally be achieved by completely eliminating coupling near the closed position, while simultaneously blocking the shutter with the rotary bezel (but not vice versa). In other words, the safety means in this embodiment enables freewheeling of the rotary bezel with respect to the shutter. Only when the freewheeling range is left by an active rotation of the bezel (by an authorized user), the "normal" bidirectional coupling to the shutter begins (and blocking of the shutter stops), so that further rotation of the rotary bezel can cause the desired opening of the shutter.

Blocking the movement that only operates from the rotary bezel to the shutter (without the simultaneously blocking of the rotary bezel) can be achieved, for example, when the safety means include in the closed position two contact points between the shutter and the rotary bezel, wherein the possible movement directions of these points are perpendicular to each other. In this case, the contact point of the rotary bezel can "block the path" for the contact point of the shutter and hence block a movement of the shutter, while its own mobility is unaffected (in the transverse direction). Furthermore, the mutually perpendicular movement directions ensure that a pressure of the shutter on the contact point of the rotary bezel has no force component that could initiate a rotation of the rotary bezel.

A particularly preferred embodiment of the invention relates to a closure device (as well as an associated plug-in device system) which includes the following combination of the aforedescribed features:

- It includes a rotary bezel with a through-opening into which the second plug-in device element can engage with a rotation-lock (for example, by a form fit).
- It includes at least one shutter, which is supported on a spring plate and is movable in a plane perpendicular to the spring plate.
- Locking pins and holes are provided on the shutter and the rotary bezel, which are in engagement in a closed position of the shutter and the rotary bezel, and which are decoupled by applying pressure on the spring-loaded shutter.
- A rotation of the rotary bezel beginning in the closed position (subsequent to the aforementioned decoupling) moves the shutter, after an initial freewheeling, via a toothing from its closed position to an open position.
- Shutter and rotary bezel are coupled via a cam pin and a cam so that (only) the movement of the shutter is blocked when the rotary bezel and the shutter are in the closed position.

BRIEF DESCRIPTION OF THE DRAWING

In the following, the invention will be described in greater detail with reference to the Figures, wherein.

DETAILED DESCRIPTION OF PREFERRED EMBODIMENTS

Figure 1:
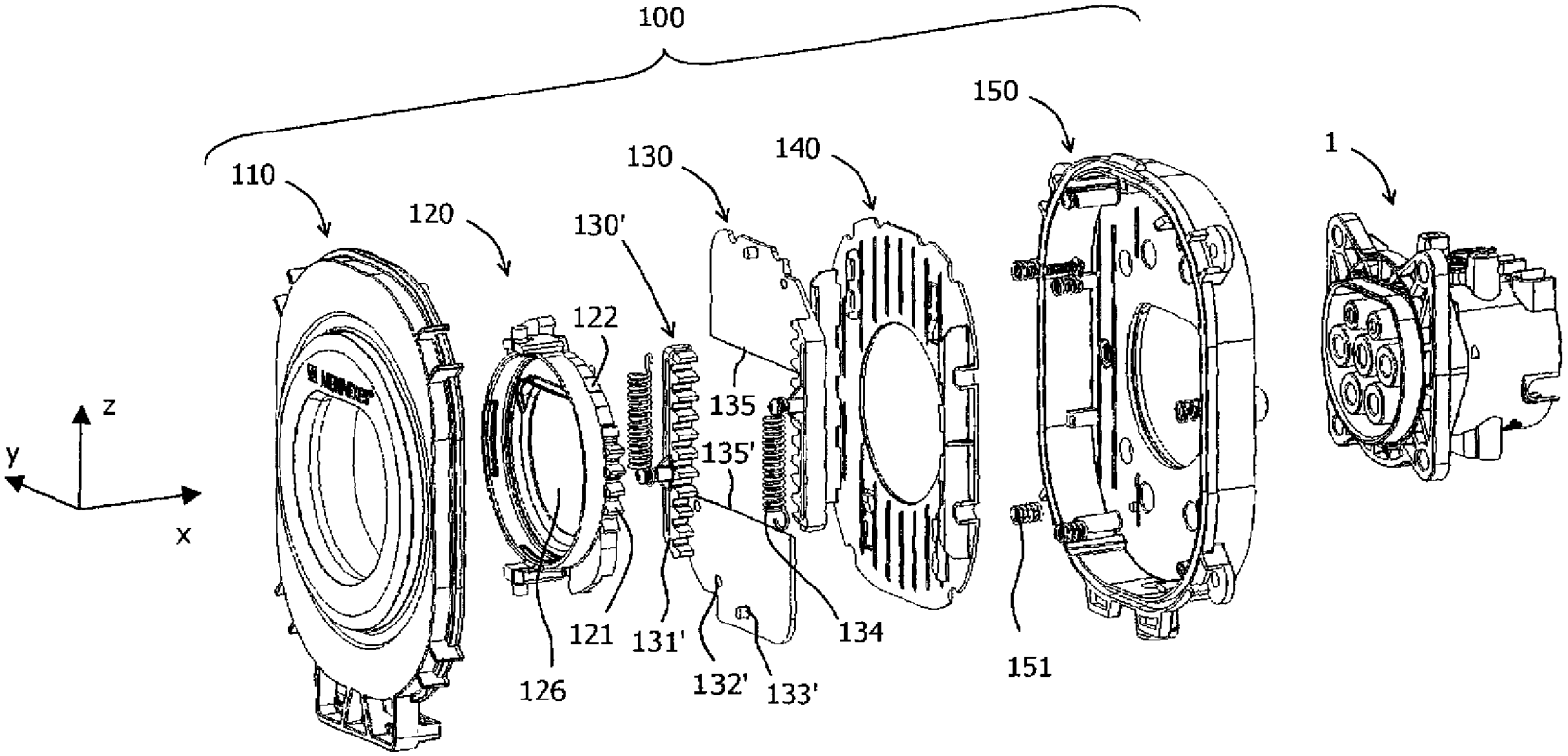
FIG. 1 shows an exploded view of a closure device according to the present invention with a first plug-in connection element.

FIG. 1 shows a perspective exploded view of the components of a closure device 100 according to the invention and the corresponding first plug-in device element, which in the illustrated example is a socket 1 (in principle, however, it could also be a plug). The closure device is intended to close the access side of the socket 1 when not in use and thus prevent unauthorized access. At the same time, however, access to the socket 1 should be possible for a second complementary plug-in device element in an insertion direction x (in this case, for a plug 2). To achieve this, the closure device 100 includes the following components:

- A front panel 110 which closes the closure device to the outside and which is typically integrated into the wall of an apparatus, for example in the housing wall for a charging station for electric vehicles. The front panel 110 is not shown in FIGS. 2-5, and 10-12 for sake of clarity.
- A rotary bezel 120 which is supported inside the closure device 100 for rotation about the insertion axis x. The rotary bezel 120 is shown in FIG. 1 in its "open position" wherein access of a plug to the socket 1 is unobstructed. The Rotary bezel 120 has on its outside teeth 121 arranged in a circular arc, which transition into a freewheel 122 without teeth. The rotary bezel 120 is preferably biased into the closed position (FIG. 2) by a spring (not shown).
- Two mirror-symmetrically arranged, but otherwise identical shutters 130 and 130'. These are essentially composed of a shutter plate and a rack 131, 131' attached to the side. The shutters 130, 130' are also shown in FIG. 1 in their open position, where they allow unobstructed access to outlet 1.
- The shutters are pulled by springs 134 (connected to the housing 150) from the illustrated open position into the closed position (FIG. 2) where they touch each other at their abutting edges 135, 135'. The abutting edges are preferably step-shaped in the x-direction, so as to tightly seal in spite of component tolerances. Different from the illustrated embodiments, the abutting edges can optionally also be uneven, having for example protuberances and corresponding recesses. In this way, starting from the closed position, individual contact sockets of the socket 1 may, if desired, still be covered over a longer travel.
- A spring plate 140 on which the shutters 130, 130' are mounted for movement in the z direction.
- A housing 150, in which the spring plate 140 (in conjunction with the shutters 130, 130') is supported on springs 151 for movement in the insertion direction x.

Figure 2:
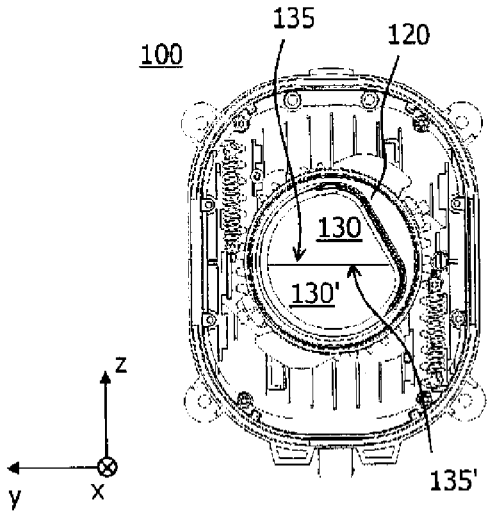
FIG. 2 shows a plan view of the closure device of FIG. 1 in the closed position.
Figure 3:
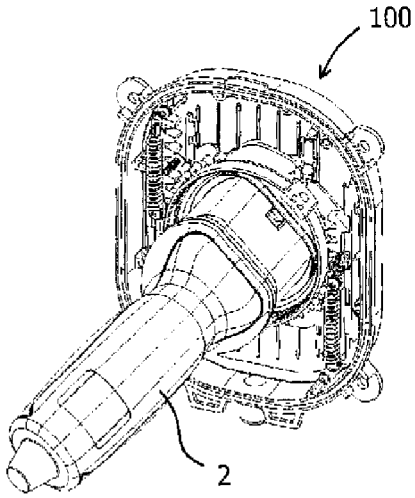
FIG. 3 shows the closure device of FIG. 2 with an attached second plug-in device element.

FIGS. 2 to 5 show the closure device 100 (without the front panel) in the assembled state. Specifically, FIG. 2 shows the closure device 100 with the shutters 130, 130' and the rotary bezel 120 in the closed position. The abutting edges 135, 135' of the bezels touch each other, and access to the socket is obstructed. FIG. 3 shows the closure device 100 in the same state with attached plug 2.

Figure 4:
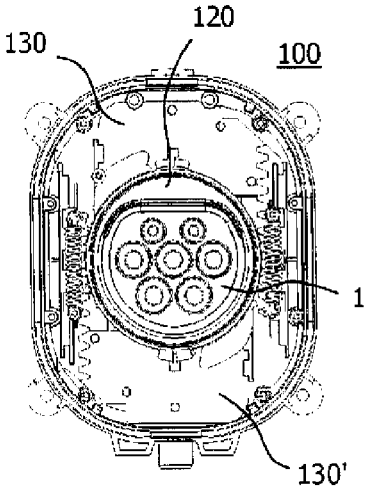
FIG. 4 shows a plan view of the closure device of FIG. 2 in the open position.
Figure 5:
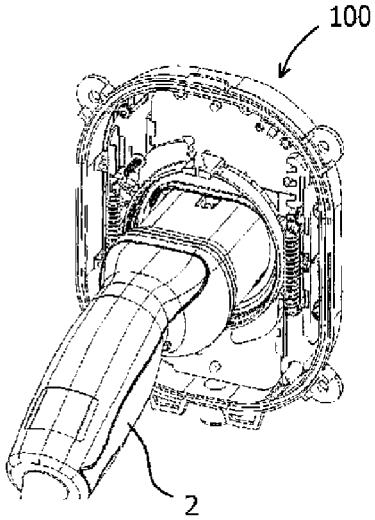
FIG. 5 shows the closure device of FIG. 4 with an attached second plug-in device element.
Figure 6:
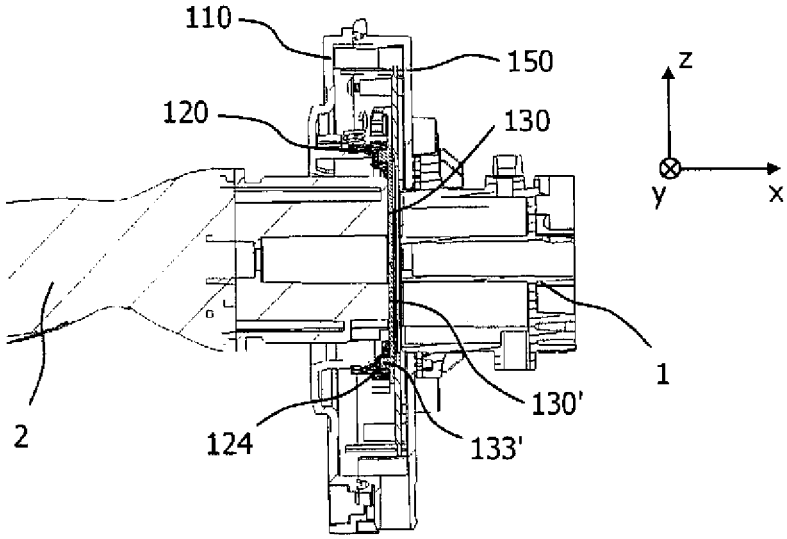
FIG. 6 shows a section through the closure device of FIG. 1 with a loose contact of a second plug-in device element on the shutter.

FIG. 4 shows the closure device 100 with the shutters 130, 130' and the rotary bezel 120 in the open position where access to the socket 1 is unobstructed. FIG. 5 shows this condition with attached plug 2.

The rotary bezel 120 is rotated in the opening position by about 60° compared to the closed position. This rotation is enabled by the plug 2, which engages with the non-circular outside contour of its front end in form-fitting inside contour of the through-opening 126 in the rotary bezel 120.

By rotating the plug 2 about the insertion axis x (as well as by applying pressure on the shutters 130, 130', see below), the rotary bezel 120 co-rotates about the x-axis. The rotation of the rotary bezel 120 is converted into opposing translational movements of the shutters 130, 130' (in the positive and negative z-direction) through the engagement of the bezel's teeth 121 in the racks 131, 131' of the shutters 130, 130'. The shutters are thereby shifted to their open position.

To prevent the closure device 100 from being opened by misuse without a plug by rotating the rotary bezel by hand or with a tool, the rotary bezel 120 tapers off on the inside contour of the through-opening 126 to be very narrow. The rotary bezel therefore provides scarcely a surface for a finger or a tool and can be safely operated only by the front end of a plug that exactly matches to the inside contour.

To further prevent unauthorized operation of the rotary bezel in the closed position, locking means are additionally provided, which will now be explained in more detail with reference to FIGS. 6 through 9. The locking means block the rotational mobility of the rotary bezel 120 and shutters 130, 130' in the closed position for as long as the blocking is not released by a specific operating step. Merely rotating the rotary bezel 120 is therefore insufficient to open the closure device 100.

Figure 15:
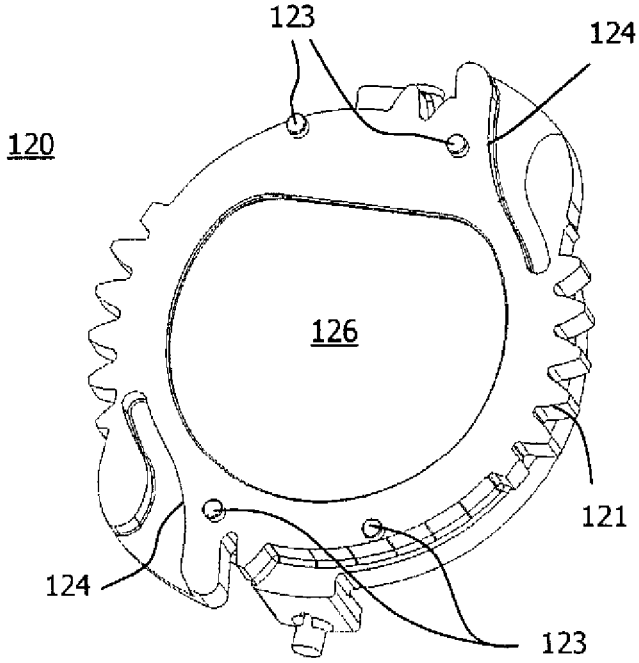
FIG. 15 shows a perspective view of the rotary bezel of the closure device from the rear.

In the embodiment shown in the Figures, the locking means are realized by arranging protrusions in the form of locking pins 123 (FIG. 15) on the rear side of the rotary bezel 120. These locking pins engage in corresponding holes 132, 132' (FIG. 1, 13) of the shutters 130, 130', when rotary bezel and the shutters are in the closed position. Such state is shown in a sectional view in FIG. 6, where the plug 2 is inserted into the through-opening of the rotary bezel 120 and rests on the shutters 130, 130' without applied pressure. The plug 2 cannot be rotated in this state about the insertion x axis, since the locking pins 123 of the rotary bezel 120 engage in the holes 132, 132' of the shutters, thus blocking the rotation.

Figure 7:
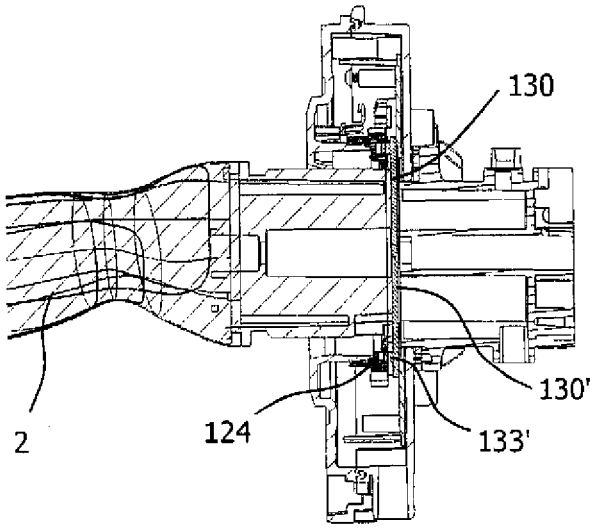
FIG. 7 shows the closure device of FIG. 6 with an applied pressure on the shutter, causing release of the locking means.

To unblock the rotary bezel and the shutters, pressure must be applied on the shutters 130, 130' in the insertion direction x, as shown in FIG. 7. Because the shutters 130, 130' (and the spring plate 140) are supported in the housing 150 for displacement, the shutters together with the spring plate 140 can yield to such pressure and move somewhat (typically by about one millimeter) in the insertion direction x. These displacements in the insertion direction are sufficient to pull the locking pins 123 of the rotary bezel 120 out of the holes 132, 132' of the shutters 130, 130', thus unblocking the movement.

Figure 8:
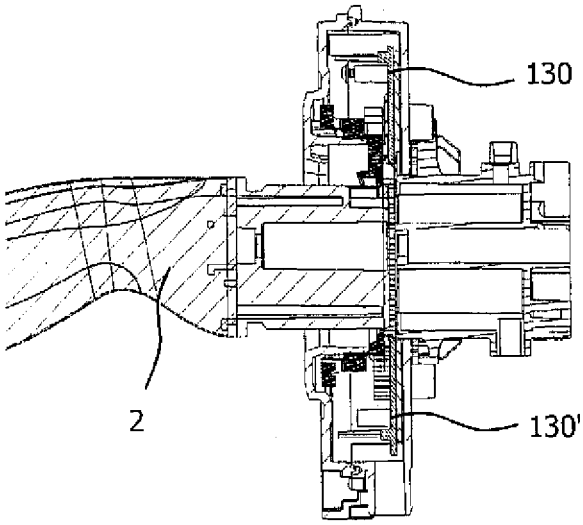
FIG. 8 shows the closure device of FIG. 7 after rotation of the second plug-in connection element in the open position.

The rotary bezel 120 can thereafter be rotated into the open position, as shown in FIG. 8, and the closure device can then be opened. After opening the shutters, the plug 2 can be fully inserted into the socket 1, as shown in FIG. 9.

Figure 9:
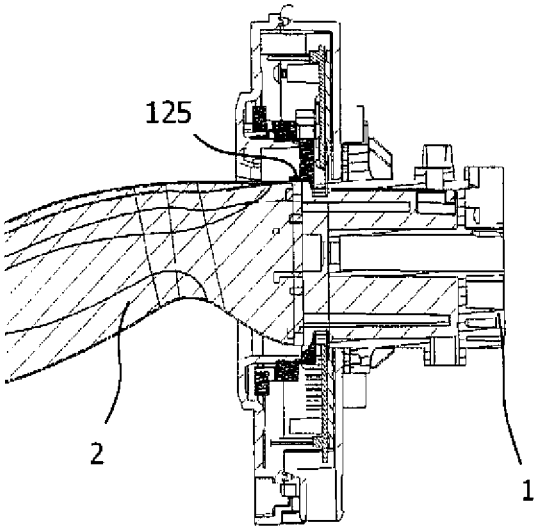
FIG. 9 shows the closure device of FIG. 8 after complete insertion of the second plug-in connection element into the first plug-in connection element.

FIG. 9 also shows that a collar 125 on the rotary bezel 120 covers a groove, wherein the groove may be formed, as illustrated, between the front end and the handle of a plug 2. This prevents the rotary bezel 120 and the shutters 130, 130' from entering this groove, which could block withdrawal of the plug.

The described locking means prevent the closure device from being opened by direct rotation of the rotary bezel 120, because the closure device can only be opened by a combination of this rotation with pressure on the shutters.

The invention additionally provides optional safety means which can also prevent a direct manipulation of the shutters 130, 130'. The safety means should in particular prevent the closure device from being opened by applying pressure on the shutters in the insertion direction x (to release the locking means) and subsequently pushing the shutters in the z direction.

Figure 10:
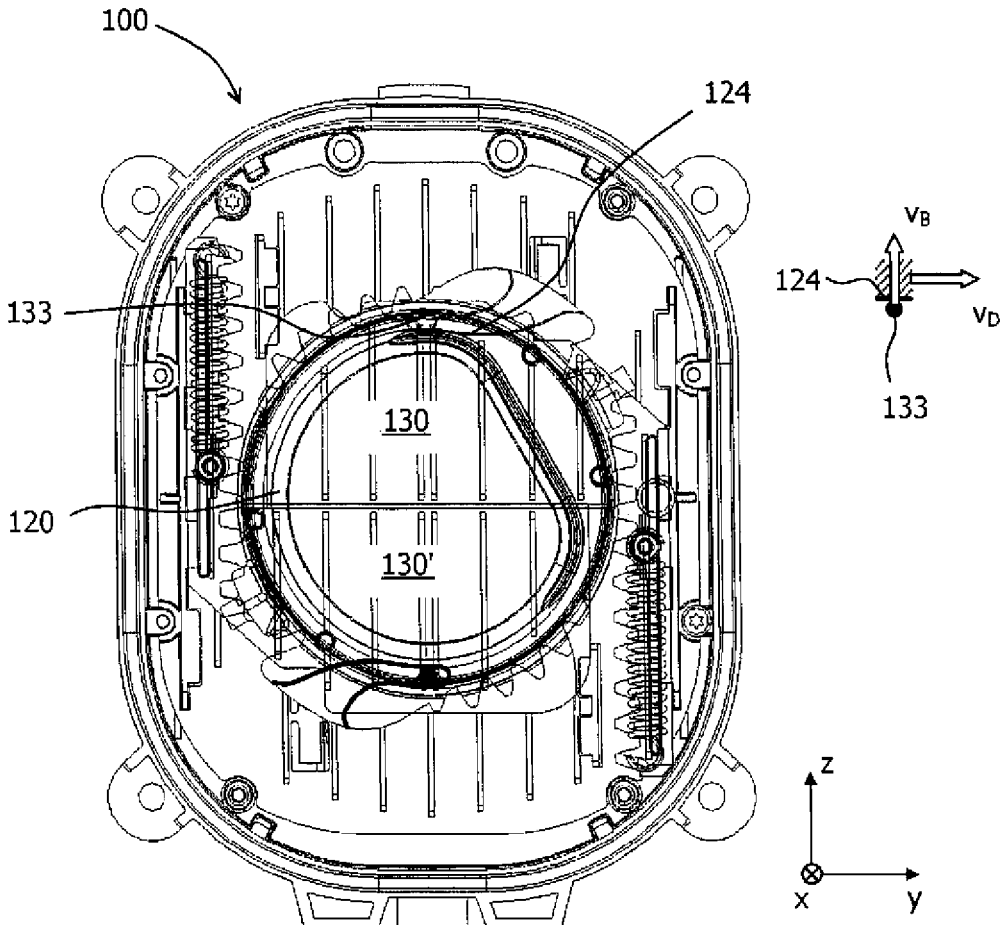
FIG. 10 shows a plan view of the closure device of FIG. 1 in the closed position with a transparent rotary bezel.
Figure 11:
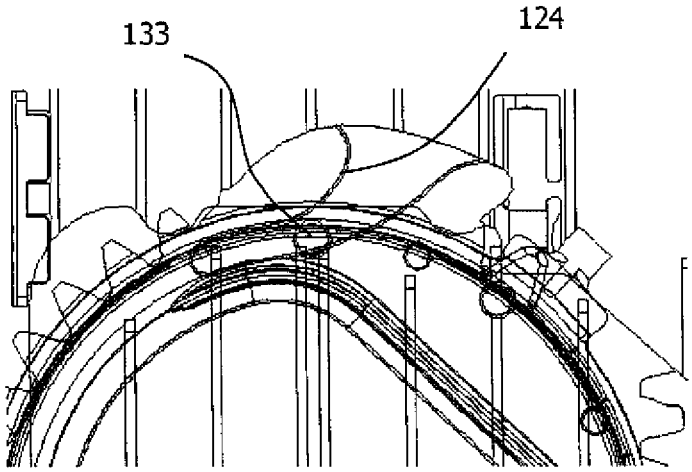
FIG. 11 shows an enlarged detail of the closure device FIG. 10 after rotation to the end of the freewheeling.
Figure 12:
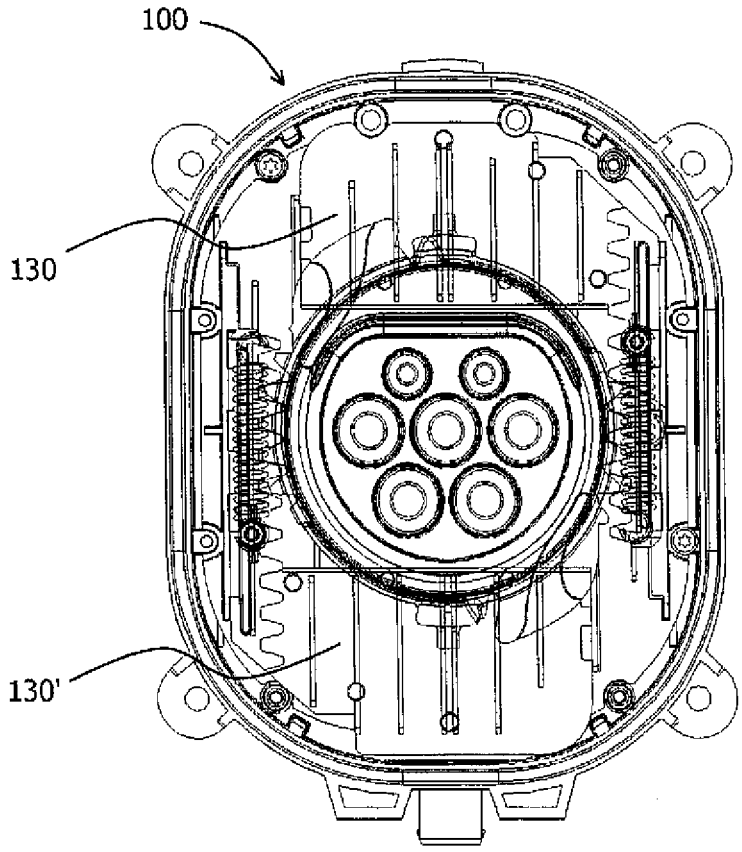
FIG. 12 shows a plan view of the closure device of FIG. 10 after rotation into the open position.
Figure 13:
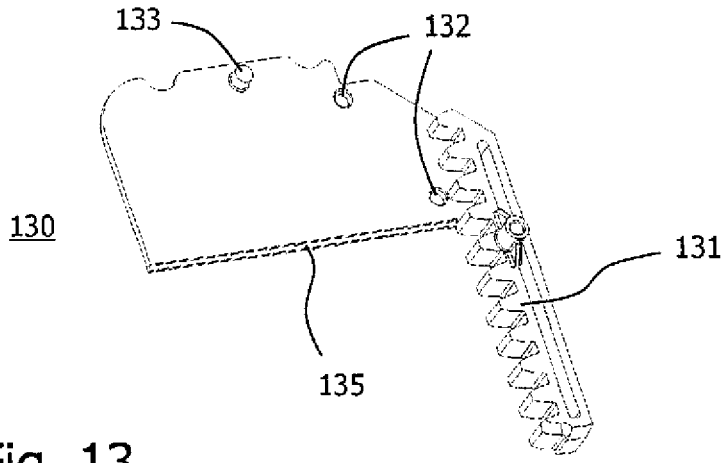
FIG. 13 shows a perspective view of a shutter of the closure device.
Figure 14:
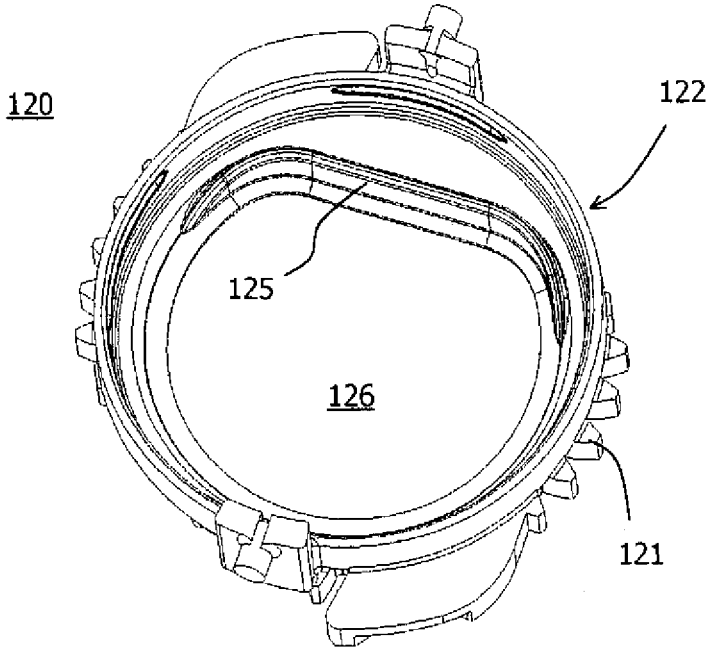
FIG. 14 shows a perspective view of the rotary bezel of the closure device from the front.

This goal can be achieved, for example, by the safety means illustrated in FIGS. 10-12, where the rotary bezel 120 is shown partly transparent. The rotary bezel 120 has on its rear side two gates 124 (see FIG. 15), with respective guide pin 133 or 133' of the shutters 130, 130' engaging in a corresponding gate 124. The gate and the associated gate pin are highlighted in the lower part of FIG. 10. The effect of these elements is described using the upper gate 124 and the guide pin 133 of the upper shutter 130 as an example, because the functionality of the lower elements 124, 133' similar (mirror image). The relevant "points of contact" 124 and 133 between the rotary bezel 120 and the shutter 130 are shown once more separately in the right part of FIG. 10.

FIG. 10 shows the rotary bezel 120 and the shutters 130, 130' in the closed position. The gates 124 and the guide pin 133 have points of contact with each other, with their possible movement directions $v_D$ (gate 124 and rotary bezel 120, respectively) and $v_B$ (guide pin 133 and shutter 130, respectively) being perpendicular to each other. In other words, the guide pin 133 is located at dead center of the gate 124. A manipulation force acting in z-direction ($v_B$) on the shutter 130 is therefore unable to produce a force component that would initiate a rotation of the rotary bezel 120. A displacement of the shutter 130 is therefore permanently blocked. This realizes the desired safety of the closure device 100 against application of an abusive force to the shutters 130 and 130'.

The aforedescribed safety means are completed by providing a toothless free wheel 122 on the rotary bezel 120. The rotary bezel 120 is thus not yet coupled to the toothed racks 131, 131' of the bezels 130, 130' in the closed position. If such a connection would already exist, application of a force acting on the shutter could then produce a rotation of the rotary bezel 120 and release blocking between guide pin 133, 133' and the gates 124. Ultimately, it would depend on the respective component tolerances, which of the two conflicting movement mechanisms (blocking by guide pin 133, 133' and gate 124 or bidirectional coupling movement by teeth (121, 131) would gain the upper hand. With the freewheel 122, a clear priority is defined for blocking between pins and gate.

What is claimed is:

1. An electrical plug-in device system, comprising:

a first plug-in device element, a second plug-in device element compatible with the first plug-in device element, said first plug-in device element and said second plug-in device element configured to be connected in an insertion direction;

a closure device arranged in front of the first plug-in device element;

wherein the closure device comprises:

a) a rotatable bezel having a through-opening configured to engage with the second plug-in device element with a rotation lock;

b) at least one shutter movable between a closed position and an open position; and c) a coupling configured to convert a rotational movement of the rotary bezel into a linear movement of the shutter from the closed position to the open position.

2. The plug-in device system of claim 1, wherein the closure device comprises a locking assembly configured to prevent at least one of the shutter and the rotary bezel from moving in the closed position, wherein the locking assembly is released by pressure acting on the shutter in the insertion direction.

3. The plug-in device system of claim 1, wherein the shutter is supported for movement in the insertion direction against a restoring force.

4. The plug-in device system of claim 2, wherein the locking assembly comprises projections which engage in holes.

5. The plug-in device system of claim 1, wherein the closure device comprises a safety device, which blocks in the closed position a movement of the shutter produced by direct application of force on the shutter.

6. The plug-in device system of claim 5, wherein the safety device blocks the movement of the shutter in the closed position produced by direct application of force on the shutter even when the locking assembly is unblocked.

7. The plug-in device system of claim 5, wherein the safety device comprises a free-wheel which decouples rotation of the rotary bezel from movement of the shutter proximate to the closed position.

8. The plug-in device system of claim 5, wherein the safety device comprises two points of contact on the shutter and the rotary bezel that contact each other in the closed position and have mutually perpendicular movement directions.

9. A closure device for controlling access of a second plug-in device element to a complementary first plug-in device element, comprising:

a) a rotatable bezel having a through-opening configured to engage with the second plug-in device element with a rotation lock;

b) at least one shutter movable between a closed position and an open position; and c) a coupling configured to convert a rotational movement of the rotary bezel into a linear movement of the shutter from the closed position to the open position.

10. The closure device of claim 9, wherein the closure device comprises a locking assembly configured to prevent at least one of the shutter and the rotary bezel from moving in the closed position, wherein the locking assembly is released by pressure acting on the shutter in an insertion direction.

11. The closure device of claim 9, wherein the shutter is supported for movement in an insertion direction against a restoring force.

12. The closure device of claim 10, wherein the locking assembly comprises projections which engage in holes.

13. The closure device of claim 9, wherein the closure device comprises a safety device, which blocks in the closed position a movement of the shutter produced by direct application of force on the shutter.

14. The closure device of claim 13, wherein the safety device blocks the movement of the shutter in the closed position produced by direct application of force on the shutter even when the locking assembly is unblocked.

15. The closure device of claim 13, wherein the safety device comprises a free-wheel which decouples rotation of the rotary bezel from movement of the shutter proximate to the closed position.

16. The closure device of claim 13, wherein the safety device comprises two points of contact on the shutter and the rotary bezel that contact each other in the closed position and have mutually perpendicular movement directions.

17. A method for controlling access of a second plug-in device element to a complementary first plug-in device element, comprising:

blocking with at least one shutter access to the first plug-in device element when the at least one shutter is in a closed position;

bringing the second plug-in device element into rotation-locked engagement with a rotary bezel and thereafter rotating the second plug-in device element;

moving the shutter in a linear direction by rotating the rotary bezel from the closed position into an open position, wherein the shutter unblocks access to the first plug-in device element; and inserting the second plug-in device element into the first plug-in device element by movement along an insertion axis.

18. The method of claim 17, further comprising the steps of preventing at least one of the shutter and the rotary bezel from moving in the closed position by way of a locking assembly, and releasing the locking assembly by applying pressure on the shutter in the insertion direction.

19. The method of claim 17, wherein the shutter is supported for movement in the insertion direction against a restoring force.

20. The method of claim 18, wherein the locking assembly comprises projections which engage in holes.

21. The method of claim 17, further comprising blocking with the closure device movement of the shutter in the closed position produced by direct application of force on the shutter.

22. The method of claim 21, wherein the safety device blocks the movement of the shutter in the closed position produced by direct application of force on the shutter even when the locking assembly is unblocked.

23. The method of claim 21, further comprising decoupling with a free-wheel a rotation of the rotary bezel from a movement of the shutter proximate to the closed position.

24. The method of claim 21, wherein the safety device comprises two points of contact on the shutter and the rotary bezel that contact each other in the closed position and have mutually perpendicular movement directions.

25. A closure device for controlling access of a second plug-in device element to a complementary first plug-in device element, comprising:

a) a rotary bezel having a through-opening configured to engage with the second plug-in device element with a rotation lock;

b) at least one shutter which is supported on a spring plate and is movable in a plane perpendicular to the spring plate;

locking pins and holes provided on the shutter and the rotary bezel, which are in engagement in a closed position of the shutter and the rotary bezel, and which are decoupled by applying pressure on the spring-supported shutter;

wherein a rotation of the rotary bezel starting at the closed position moves the shutter after initial free-wheeling via a toothing from the closed position into an open position;

a guide pin and a gate coupling the shutter and the rotary bezel such that movement of the shutter is blocked when the shutter and the rotary bezel are both in the closed position.

* * * * *

UNITED STATES PATENT AND TRADEMARK OFFICE

CERTIFICATE OF CORRECTION

PATENT NO. : 8,845,345 B2
APPLICATION NO. : 14/005086
DATED : September 30, 2014
INVENTOR(S) : Stefan Gattwinkel et al.

It is certified that error appears in the above-identified patent and that said Letters Patent is hereby corrected as shown below:

On the title page, item (74) should read: "Henry M. Feiereisen LLC"

Signed and Sealed this
Thirteenth Day of January, 2015

Michelle K. Lee

Michelle K. Lee
*Deputy Director of the United States Patent and Trademark Office*